US005405698A

United States Patent [19]

Dugan

[11] Patent Number: 5,405,698

[45] Date of Patent: Apr. 11, 1995

[54] COMPOSITE FIBER AND POLYOLEFIN MICROFIBERS MADE THEREFROM

[75] Inventor: Jeffrey S. Dugan, Asheville, N.C.

[73] Assignee: BASF Corporation, Parsippany, N.J.

[21] Appl. No.: 40,714

[22] Filed: Mar. 31, 1993

[51] Int. Cl.[6] ..... D02G 3/00

[52] U.S. Cl. ..... 428/373; 428/370; 428/374

[58] Field of Search ..... 428/370, 364, 373, 374; 525/57; 264/143

[56] References Cited

U.S. PATENT DOCUMENTS

| | | | |
|---|---|---|---|
| 4,127,696 | 11/1978 | Okamoto | 428/373 |
| 4,966,808 | 10/1990 | Kauano | 428/374 |
| 5,051,222 | 9/1991 | Marten et al. | 264/143 |
| 5,059,482 | 10/1991 | Kawamoto et al. | 428/370 |
| 5,087,519 | 2/1992 | Yamaguchi et al. | 428/374 |
| 5,124,194 | 6/1992 | Kawano | 428/374 |
| 5,137,969 | 8/1992 | Marten et al. | 525/56 |
| 5,162,074 | 11/1992 | Hills | 156/644 |

FOREIGN PATENT DOCUMENTS

| | | |
|---|---|---|
| 52-005318 | 8/1977 | Japan . |
| 498672A2 | 12/1992 | Japan . |

*Primary Examiner*—Newton O. Edwards

[57] ABSTRACT

A composite fiber of at least two different polymers, one of which is a water-insoluble polyolefin and the other is a water-soluble polymer, having a plurality of at least 19 segments of the water-insoluble polyolefin, uniformly distributed across the cross-section of the fiber and being surrounded by the water-soluble polymer, a process for the manufacture of such a fiber and a process for the manufacture of microfibers therefrom.

11 Claims, 8 Drawing Sheets

COMPOSITE FIBER AND POLYOLEFIN MICROFIBERS MADE THEREFROM

FIELD OF THE INVENTION

The present invention relates to a composite fiber, and polyolefin microfiber made therefrom, a process for the manufacture of the composite fiber as well as a process for the production of the polyolefin microfiber. In particular it relates to a composite fiber, comprising a polyolefin which is water insoluble and a water soluble polymer.

BACKGROUND OF THE INVENTION

Composite fibers and microfibers made therefrom as well as different processes for their manufacture are well known in the art.

The composite fibers are manufactured in general by combining at least two incompatible fiber-forming polymers via extrusion followed by optionally dissolving one of the polymers from the resultant fiber to form microfibers.

U.S. Pat. No. 3,700,545 discloses a multi-segmented polyester or polyamide fiber having at least 10 fine segments with cross sectional shapes and areas irregular and uneven to each other.

The spun fibers are treated with an alkali or an acid to decompose and at least a part of the polyester or polyamide is removed.

Described is a complex spinnerette for the manufacture of such fibers.

U.S. Pat. No. 3,382,305 discloses a process for the formation of microfibers having an average diameter of 0.01 to 3 microns by blending two incompatible polymers and extruding the resultant mixture into filaments and further dissolving one of the polymers from the filament. The disadvantage of this process is, that the cross section of these filaments is very irregular and uneven, so that the resulting microfibers are irregular, uneven and having varying diameters.

U.S. Pat. No. 5,120,598 describes ultra-fine polymeric fibers for cleaning up oil spills. The fibers were produced by mixing an polyolefin with poly (vinyl alcohol) and extruding the mixture through a die followed by further orientation. The poly (vinyl alcohol) is extracted with water to yield ultra-fine polymeric fibers. The disadvantage of this process is that the cross section is irregular and uneven which is caused by the melt extrusion and what results in irregular and uneven microfibers and the islands, which form the microfibers after the hydrolysis, are discontinuous, which means that they are not continuous over the length of the composite fibers.

EP-A-0,498,672 discloses microfiber generating fibers of island-in-the-sea type obtained by melt extrusion of a mixture of two polymers, whereby the sea polymer is soluble in a solvent and releases the insoluble island fiber of a fineness of 0.01 denier or less. Described is polyvinyl alcohol as the sea polymer. The disadvantage is that by the process of melt mixing the islands-in-the-sea cross section is irregular and uneven and the islands, which form the microfibers after the hydrolysis, are discontinuous, which means that they are not continuous over the length of the composite fibers.

Object of the present invention is to provide a composite fiber with a cross-section having at least 19 segments of a polyolefin which is water-insoluble, surrounded by a water-soluble polymer, wherein the segments of the polyolefin are uniformly distributed across the cross-section of the composite fiber and are continuous over the length of the composite fiber.

Another object was to provide a process for the manufacture of such a composite polyolefin fiber.

Another object was to provide a process for the manufacture of polyolefin microfibers of a fineness of not greater than 0.3 denier from the composite fibers.

SUMMARY OF THE INVENTION

The objects of the present invention could be achieved by a composite fiber comprising at least two different polymers, one of which is a water-insoluble polyolefin and selected from the group consisting of polyethylene, polypropylene, polystyrene, polyvinyl acetate, polybutylene, copolymers and blends thereof and the other is water-soluble, having a plurality of at least 19 segments of the polyolefin, uniformly distributed across the cross-section of the fiber and being surrounded by the water-soluble polymer.

DETAILED DESCRIPTION OF THE INVENTION

Figure 1:
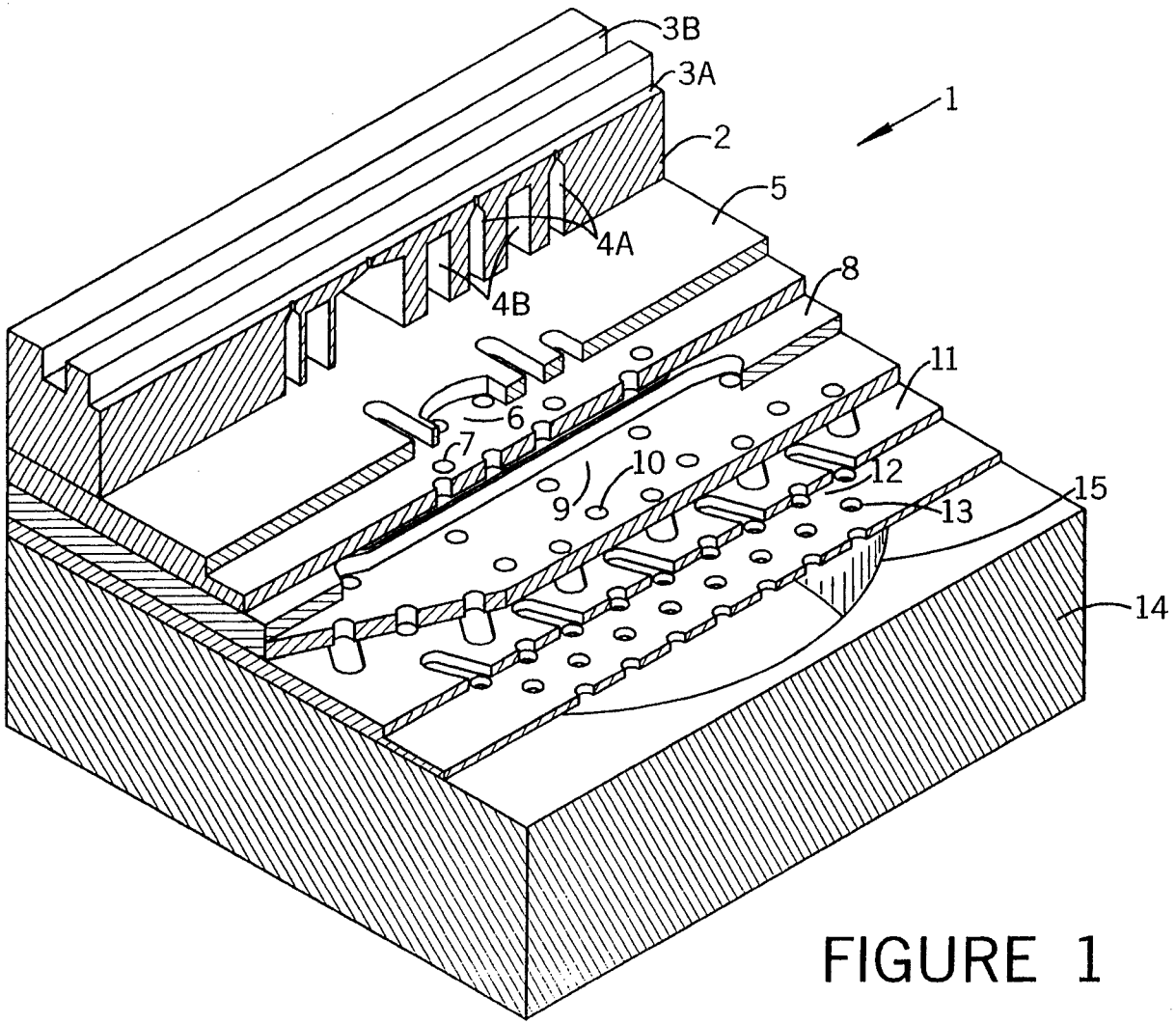
FIG. 1 is a view in perspective of a spin pack assembly.

Composite fibers are made by melting the two fiber forming polymers in two separate extruders and by directing the two flows into one spinnerette with a plurality of distribution flow paths in form of small thin tubes which are made for example, by drilling. U.S. Pat. No. 3,700,545 describes such a complex spinnerette.

In contrast to the complex, expensive and imprecise machined metal devices of the prior art, the spinnerette pack assembly of the present invention uses etched plates like they are described in U.S. Pat. No. 5,162,074.

A distributor plate or a plurality of adjacently disposed distributor plates in a spin pack takes the form of a thin metal sheet in which distribution flow paths are etched to provide precisely formed and densely packed passage configurations. The distribution flow paths may be: etched shallow distribution channels arranged to conduct polymer flow along the distributor plate surface in a direction transverse to the net flow through the spin pack; and distribution apertures etched through the distributor plate. The etching process, which may be photochemical etching, is much less expensive than the drilling, milling, reaming or other machining/cutting processes utilized to form distribution paths in the thick plates utilized in the prior art. Moreover, the thin distribution plates with thicknesses for example of less than 0.10 inch, and typically no thicker than 0.030 inch are themselves much less expensive than the thicker distributor plates conventionally employed in the prior art.

Etching permits the distribution apertures to be precisely defined with very small length (L) to diameter (D) ratios of 1.5 or less, and more typically, 0.7 or less. By flowing the individual plural polymer components to the disposable distributor plates via respective groups of slots in a non disposable primary plate, the transverse pressure variations upstream of the distributor plates are minimized so that the small L/D ratios are feasible. Transverse pressure variations may be further mitigated by interposing a permanent metering plate between the primary plate and the etched distribution plates. Each group of slots in the primary non-disposable plate carries a respective polymer component and includes at least two slots. The slots of each group are positionally alternated or interlaced with slots of the other groups so that no two adjacent slots carry the same polymer component.

The transverse distribution of polymer in the spin pack, as required for plural-component fiber extrusion, is enhanced and simplified by the shallow channels made feasible by the etching process. Typically the depth of the channels is less than 0.016 inch and, in most cases, less than 0.010 inch. The polymer can thus be efficiently distributed, transversely of the net flow direction in the spin pack, without taking up considerable flow path length, thereby permitting the overall thickness for example in the flow directing of the spin pack to be kept small. Etching also permits the distribution flow channels and apertures to be tightly packed, resulting in a spin pack of high productivity (i.e., grams of polymer per square centimeter of spinnerette face area). The etching process, in particular photo-chemical etching, is relatively inexpensive, as is the thin metal distributor plate itself. The resulting low cost etched plate can, therefore, be discarded and economically replaced at the times of periodic cleaning of the spin pack. The replacement distributor plate can be identical to the discarded plate, or it can have different distribution flow path configurations if different polymer fiber configurations are to be extruded. The precision afforded by etching assures that the resulting fibers are uniform in shape and denier.

The process for the manufacture of the composite fiber of the present invention is described with reference to FIG. 1 to 7.

FIG. 1 shows a spin pack assembly (1) for the manufacture of the composite fiber of the present invention, which includes a distribution plate (2) with polymer flow channels (3), channel (3A) is designated for the water-insoluble and microfiber forming polyolefin and channel (3B) for the water-soluble polymer and the slots (4), slot (4A) is designated for the water-insoluble and microfiber forming polymer and slot (4B) for the water-dissipatable polymer. Below the distribution plate (2) is a top etched plate (5) with etched areas (6) and through etched areas (7), followed by a middle etched plate (8) with etched areas (9) and through etched areas (10), followed by a bottom etched plate (11) with etched areas (12) and through etched areas (13), followed by a spinnerette plate (14) with a backhole (15).

Figure 2:
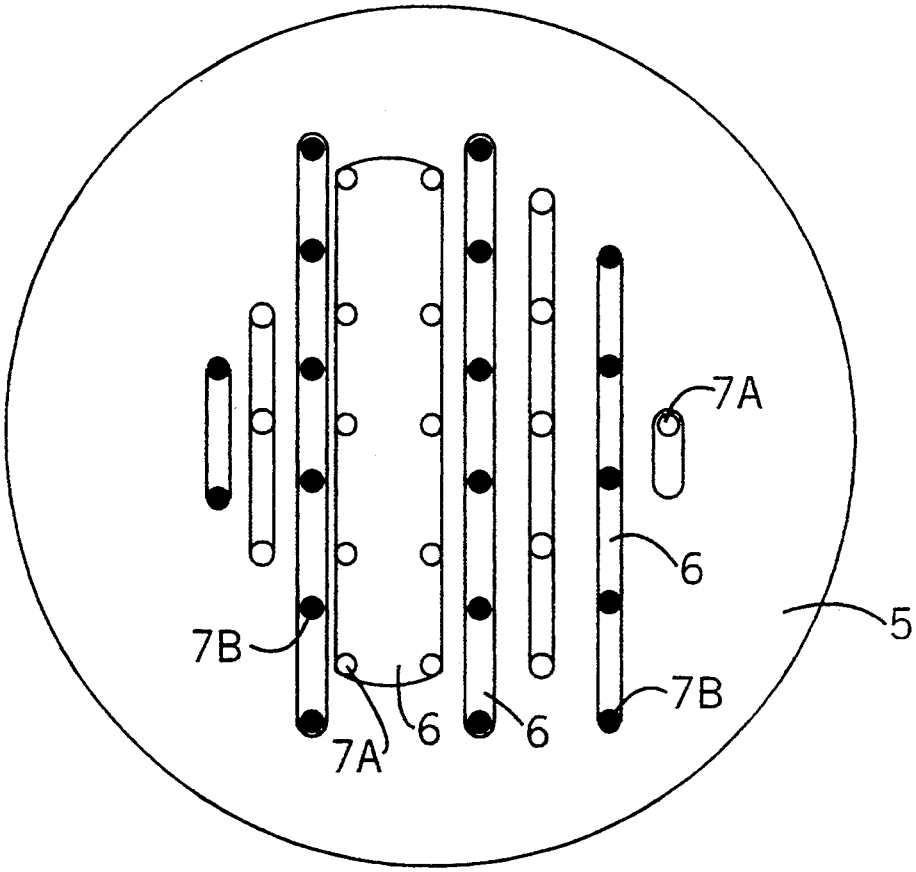
FIG. 2 is a top view in plane of the top etched plate.

FIG. 2 shows a top etched plate (5) having etched areas (6), in which the polymer flows transversely of the net flow direction in the spin pack, and through etched areas (7), through which the polymer flows in the net flow direction. Through etched areas (7A) are designated for the water-insoluble and microfiber-forming polyolefin and through-etched areas (7B) are designated for the water-soluble polymer.

Figure 3:
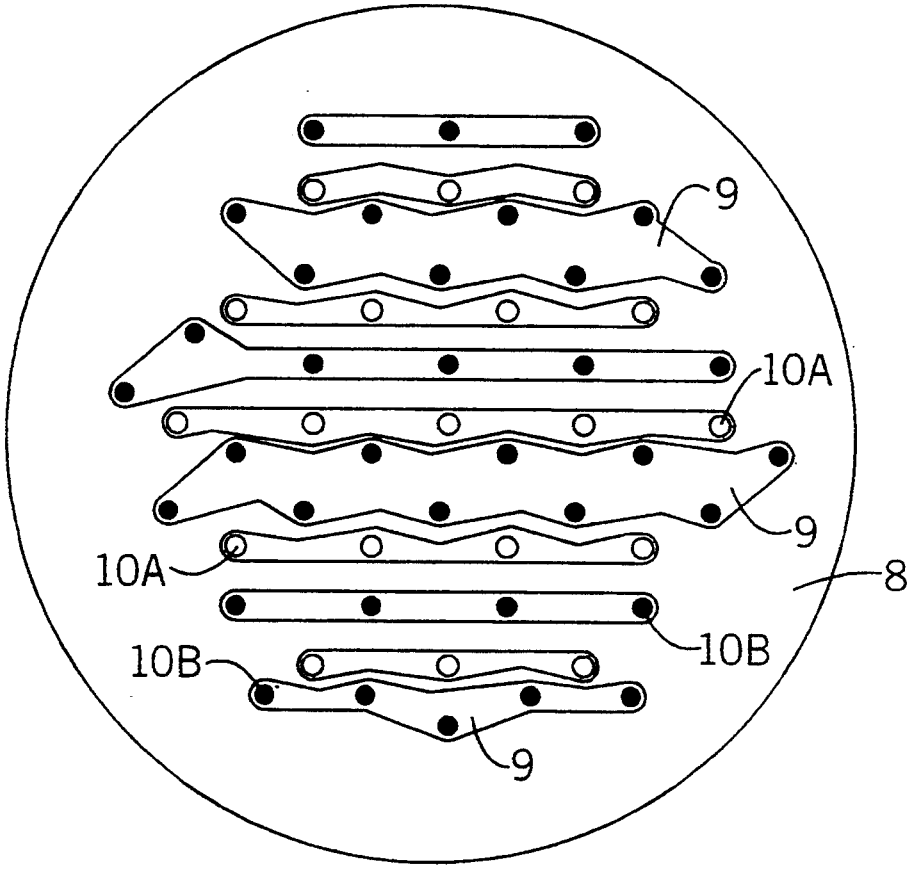
FIG. 3 is a top view in plane of the middle etched plate.

FIG. 3 shows a middle etched plate (8) having etched areas (9) and through-etched areas (10), whereby (10A) is designated for the water-insoluble polyolefin and (10B) is designated for the water-soluble polymer.

Figure 4:
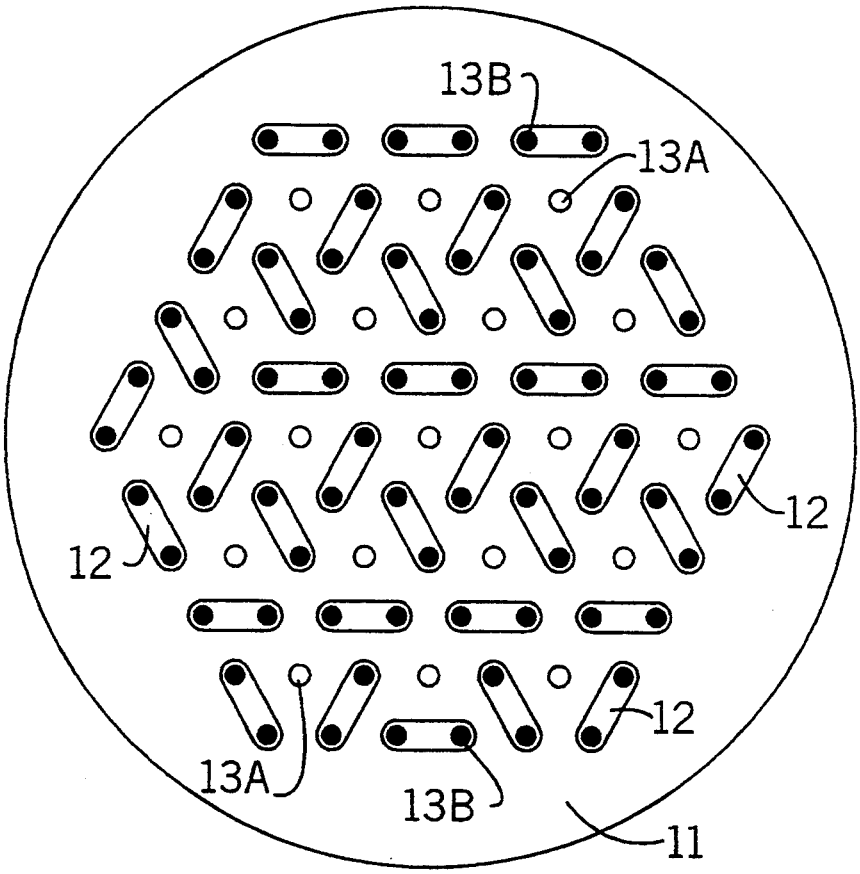
FIG. 4 is a top view in plane of the bottom etched plate with 19 island holes.

FIG. 4 shows a bottom etched plate (11) having etched areas (12) and through-etched areas (13), whereby (13A) is designated for the water-insoluble polyolefin and (13B) is designated for the water-soluble polymer.

Figure 5:
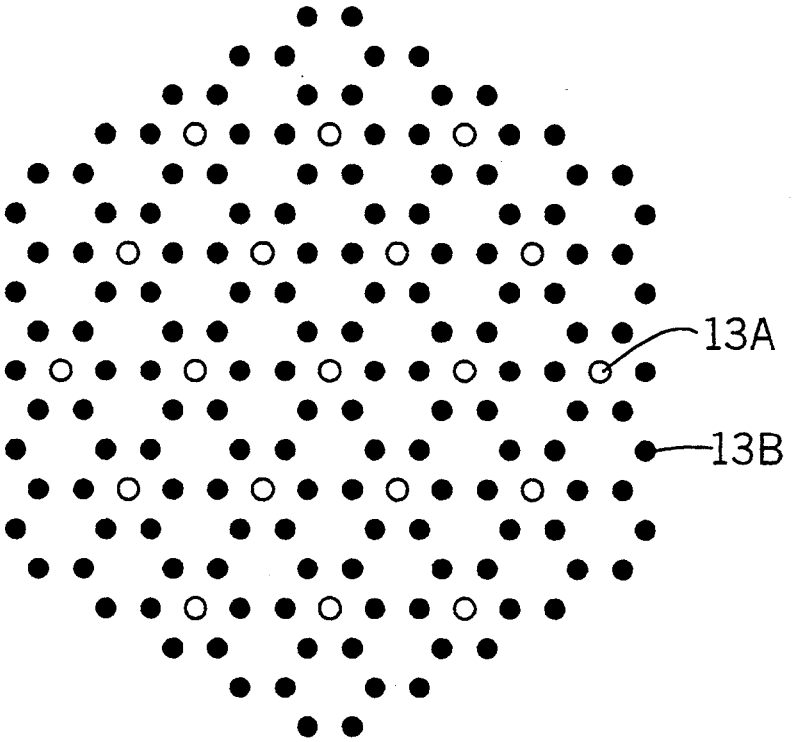
FIG. 5 is a top view in plane of "honeycomb" hole pattern of a bottom etched plate with 19 holes form the islands in the fiber.

FIG. 5 shows a "honeycomb" hole pattern of a bottom etched plate (11), which has 19 holes for the water-insoluble polyolefin (13A) which forms the islands in the sea of the water-soluble polymer, which flows through holes (13B).

Figure 6:
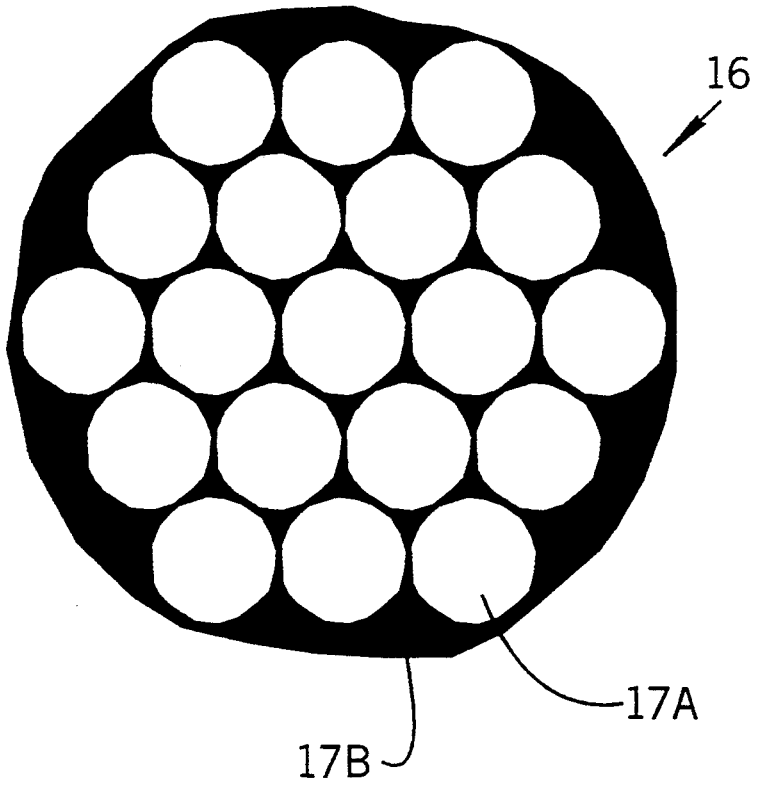
FIG. 6 is a top view in plane of a cross section of a composite fiber with 19 islands in a "honeycomb" pattern.

FIG. 6 shows a cross section of a composite fiber (16) of the present invention with 19 islands of the water-insoluble polyolefin (17A) in the sea of the water-soluble polymer (17B) in a "honeycomb" pattern.

Figure 7:
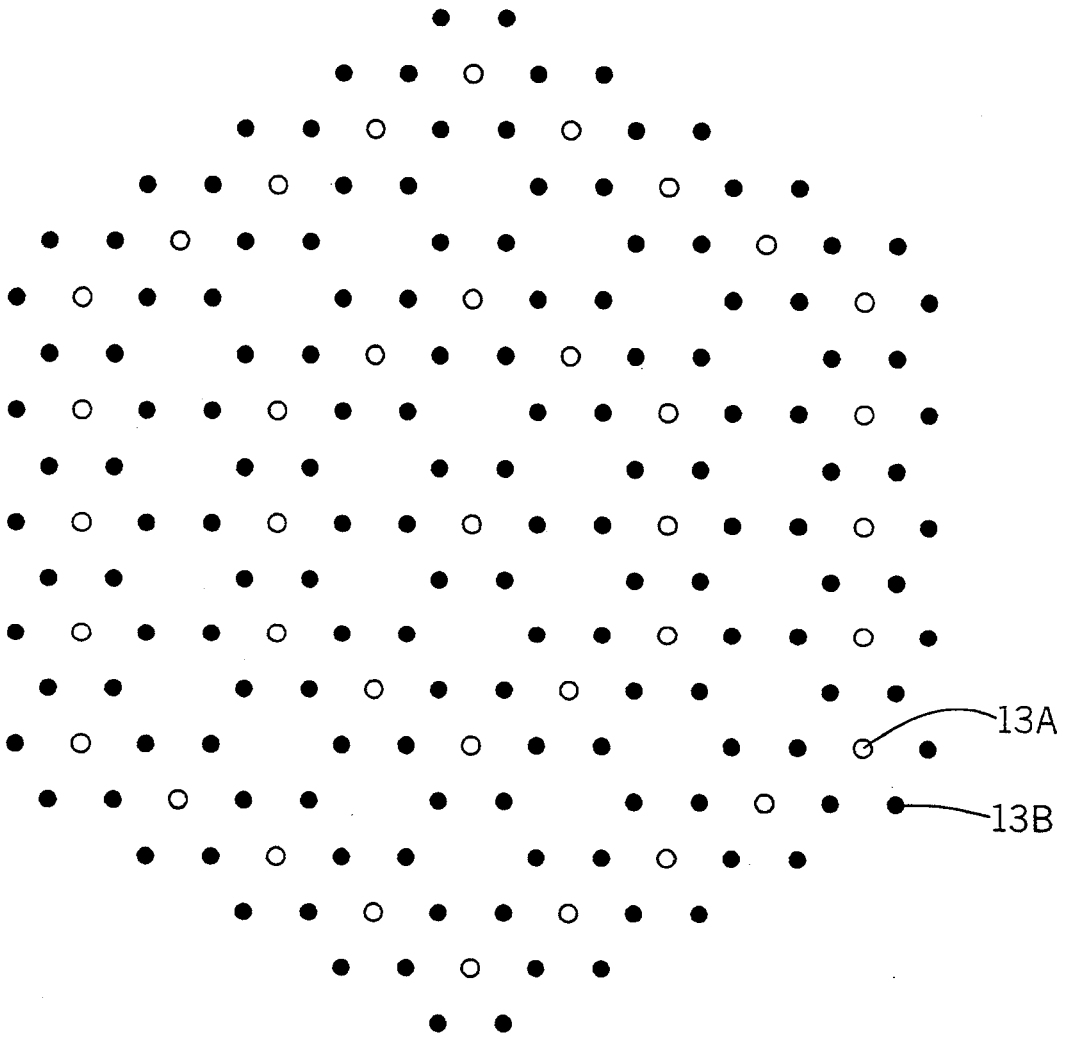
FIG. 7 is a top view in plane of a bottom etched plate with 37 holes which form the islands in the fiber.

FIG. 7 shows a hole pattern of a bottom etched plate (11), which has 37 holes for the water insoluble polyolefin (13A) and the other holes for the water-soluble polymer (13B).

Figure 8:
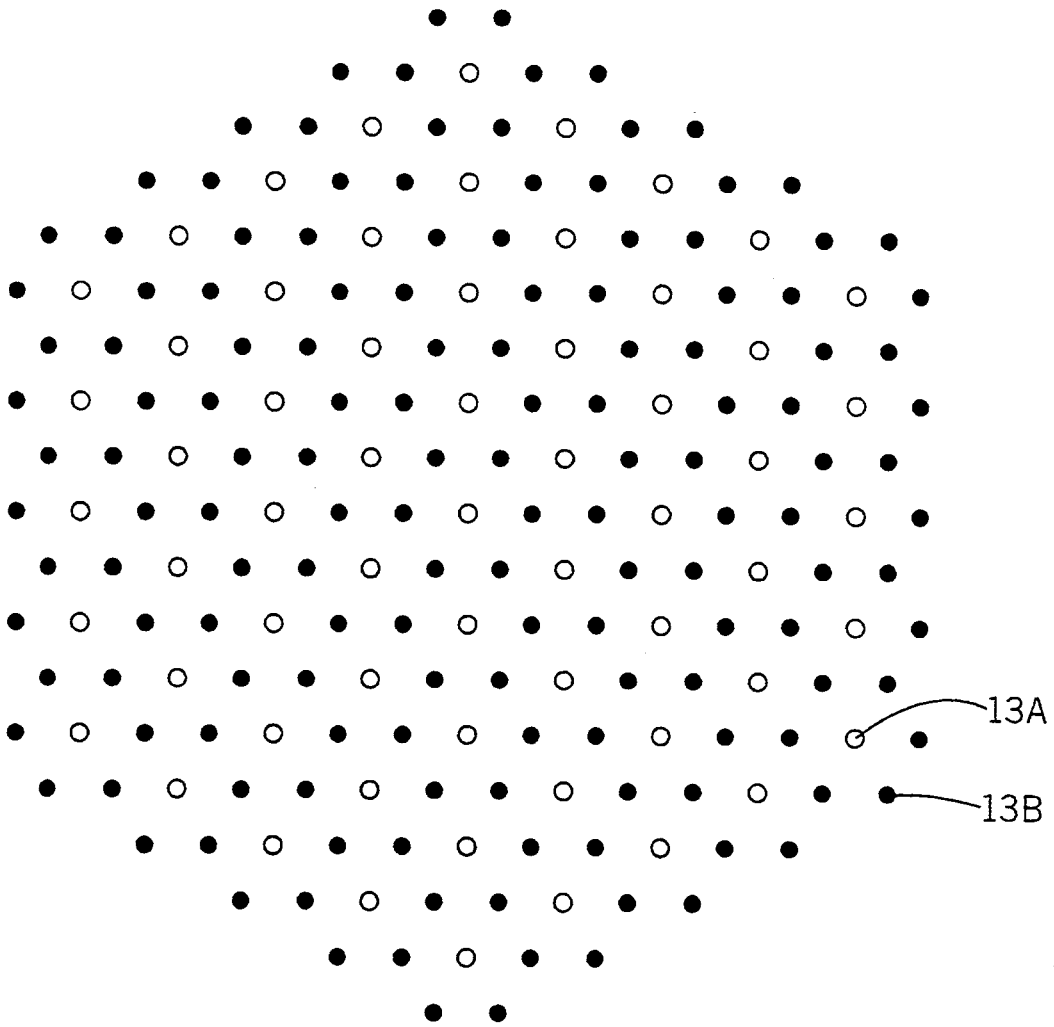
FIG. 8 is a top view in plane of a bottom etched plate with 61 holes which form the islands in the fiber.

FIG. 8 shows a hole pattern of a bottom etched plate (11), which has 61 holes for the water-insoluble polyolefin (13A) and the other holes for the water-soluble polymer (13B).

The etched plate of FIG. 4 has at least 19 through etched areas (12), which are holes through which the water-insoluble polyolefin flows, preferably at least 30 and most preferred at least 50 through etched areas (12) so, that a composite fiber, manufactured with such a spin pack has a cross section with at least 19 segments, preferable at least 30 segments and most preferred with at least 50 segments of the water-insoluble polyolefin as the islands in the sea of the water-soluble polymer.

FIGS. 4 and 5 show an etched plate having a "honeycomb" hole pattern which has 19 holes for the water-insoluble polyolefin (13A), each hole is surrounded by 6 holes for the water-soluble polymer (13B). The result is that there is no theoretical limit to the ratio of "islands" material to "sea" material. As this ratio increases from examples 30:70 to 70:30, the "island" microfilaments go from round shapes in a "sea" of soluble polymer to tightly-packed hexagons with soluble walls between the hexagons. As this ratio increases further, the walls simply become thinner. The practical limit is at which many of these walls are breached and adjacent microfilaments fuse. But the removal of the theoretical limit is new. For instance, if the microfilaments are arranged in a square grid arrangement, the maximum residual polymer content at the point of fusing is 78.5%.

It is of high economic interest, to achieve fiber smallness by increasing the number of islands and to reduce the expense of consuming and disposing of the residual "sea" polymer by minimizing its content in the macrofibers.

With etched plates having this honeycomb pattern composite fibers could be manufactured with a cross-section having more than 60 segments of water-insoluble polyolefin surrounded by the water-soluble polymer. The water-insoluble polyolefins comprise polyethylene, polypropylene, polystyrene, polyvinyl-polymers, polybutylene, copolymers and blends thereof.

Suitable polyethylenes comprise high density polyethylene, low density polyethylene, linear low density polyethylene, very low density linear polyethylene, and copolymers like etylene-propylene copolymers, ethylene-vinyl acetate, ethylene-ethyl acrylate, ethylene-methyl acrylate, ethylene-acrylic acid, ethylene-methacrylic acid, and the like.

Suitable polypropylenes are polypropylene and polypropylene polyethylene copolymers.

Suitable polystyrenes are polystyrene, polystyrene acrylonitrile copolymers, polystyrene acrylate acrylonitrile terpolymer and the like.

A suitable polyvinylpolymer is for example polyvinyl acetate.

Preferred is polyethylene, polypropylene and copolymers thereof.

The water soluble polymer useful for this invention is polyvinylalcohol, which is produced by hydrolysis of polyvinylacetate to a degree of 70 to 100%, preferably 75 to 95% based on acetate. Suitable polyvinylalcohols are described for example in U.S. Pat. No. 5,137,969 and 5,051,222, the disclosures thereof are herewith incorporated by reference. The polyvinylalcohol may contain other additives like plasticizers or other water-soluble polymers like poly(vinyl pyrrolidone), poly(ethyloxazoline) and poly(ethylene oxide).

In the process for the manufacture of the composite fibers, the water-insoluble polyolefin and the water-soluble polymer are molten in step (a) in two separate extruders into two melt flows whereby the polyolefin flow is directed to the channel (3A) of the spinnerette assembly and through slots (4A) to the etched plates (5) (8) and (11) of the spinnerette assembly and the water-soluble polymer is directed into the channel (3B) and through slots (4B) to the etched plates (5) (8) and (11) of the spinnerette assembly. The composite fibers exit the spinnerette assembly. The fibers are spun with a speed of from about 100 to about 10,000 m/min, preferably with about 800 to about 2000 m/min. The extruded composite fibers are quenched in step (b) with a cross flow of air and solidify. During the subsequent treatment of the fibers with a spin finish in step (c) it is important to avoid a premature dissolution of the water-soluble polymer in the water of the spin finish. For the present invention the finish is prepared as 100% oil (or "neat") like butyl stearate, trimethylol-propane triester of caprylic acid, tridecyl stearate, mineral oil and the like and applied at a much slower rate than is used for an aqueous solution and/or emulsion of from about 3% to about 25%, preferably from about 5% to about 10% weight. This water-free oil is applied at about 0.1 to about 5% by weight, preferably 0.5 to 1.5% by weight based on the weight of the fiber and coats the surface of the composite filaments. This coating reduces destructive absorption of atmospheric moisture by the water-soluble polymer. It also reduces fusing of the polymer between adjacent composite filaments if the polymer softens during the subsequent drawing step.

Other additives may be incorporated in the spin finish in effective amounts like emulsifiers, antistatics, antifoams, thermostabilizers, UV stabilizers and the like.

The fibers or filaments are then drawn in step (d) and, in one embodiment, subsequently textured and wound-up to form bulk continuous filament (BCF). The one-step technique of BCF manufacture is known in the trade as spin-draw-texturing (SDT). Two step technique which involves spinning and a subsequent texturing is also suitable for the manufacturing of composite fibers of this invention.

Other embodiments include flat filament (non-textured) yarns, or cut staple fiber, either crimped or uncrimped.

The process for the manufacture of microfiber fabrics comprises in step (e) converting the yarn of the present invention into a fabric by any known fabric forming process like knitting, needle punching, and the like.

In the hydrolyzing step (f) the fabric is treated with water at a temperature of from about 10° to about 100° C., preferably from about 50° to about 80° C. for a time period of from about 1 to about 180 seconds whereby the water-soluble polymer is dissolved.

The microfibers of the fabric have an average fineness of less than 0.3 denier per filament (dpf), preferably less than 0.1 and most preferred less than 0.01 dpf and the fabric has a silky touch.

EXAMPLE

Polypropylene (PP) (Soltex Fortilene XM-3907) is fed through an extruder into the top of a bicomponent spin pack containing etched plates designed to make an islands-in-the-sea cross section with 19 islands. The PP is fed into a spin pack through the port for the "island" polymer. Simultaneously, polyvinyl alcohol (PVOH) (Air Products Vinex V2025) mixed with a blue pigment chip is fed through a separate extruder into the same spin pack, through the port for the "sea" polymer. The pressure in both extruders is 1500 psig, and temperature profiles are set as follows:

| | PP | PVOH |
|---|---|---|
| Extruder zone 1 | 220° C. | 155° C. |
| Extruder zone 2 | 225° C. | 160° C. |
| Extruder zone 3 | 230° C. | 165° C. |
| Die head | 235° C. | 170° C. |
| Polymer header | 240° C. | 180° C. |
| Pump block | 240° C. | 240° C. |

A metering pump pumps the molten PP through the spin pack at 21.6 g/min. and the PVOH is pumped at 9.2 g/min. The two polymers exit the spin pack through a 37-hole spinnerette as 37 round filaments each comprising 19 PP filaments bound together by PVOH polymer. The molten filaments are solidified by cooling as they pass through a quench chamber with air flowing at a rate of 110 cubic feet per minute across the filaments. The quenched yarn passes across a metered finish applicator applying a 100% oil finish at a rate of 0.30 $cm^3$/minute, and is taken up on a core at 1250 m/min. At this point, the yarn has 37 filaments and a total denier of about 222. The yarn is then drawn on an SZ-16 type drawtwister at a speed of 625 m/min. The draw ratio is 3.0. Spindle speed is 7600 rpm, lay rail speed is 18 up/18 down, builder gears used are 36/108, 36/108, 48/96, and 85/80, and tangle jet pressure is 30 psig. Godets and hot plate are not heated. After drawing, the yarn has a total denier of about 75.

The drawn yarn is knit into a tube. The knit fabric is scoured in a standard scour for polyester fabrics, and dried. Before scouring, the fabric is a solid and even blue shade, since the PVOH is pigmented blue. After scouring, the fabric is white. This and subsequent microscopy investigation confirms that the standard scour is sufficient to remove virtually all of the PVOH. Since the PVOH comprises about 25% of the yarn before scouring, the scouring reduces the denier of the yarn to about 56. The removal of the PVOH also liberates the individual PP filaments, so the scoured yarns contain 703 PP filaments. The average PP filament, then, has a linear density of 0.08 denier.

What is claimed is:

1. A composite fiber with an island-in-a-sea cross section comprising at least two different polymers, one of which is a water-insoluble polyolefin and the other is a water-soluble polymer, having a plurality of at least 19 islands of the water insoluble polyolefin, the islands having an average fineness of not greater than 0.3 denier per filament and being uniformly distributed across the cross section of the fiber and being continuous over the length of the composite fiber and being surrounded by the sea of the water-soluble polymer.

2. The fiber according to claim 1, wherein the water-insoluble polyolefin is selected from the group consisting of polyethylene, polypropylene, polystyrene, polyvinyl-polymers, polybutylene, copolymers and blends thereof.

3. The fiber according to claim 2, wherein the water-insoluble polymer is selected from the group consisting of polyethylene, polypropylene, and copolymers and blends thereof.

4. The fiber according to claim 1, wherein the water-soluble polymer is polyvinylalcohol.

5. The fiber according to claim 4, wherein the polyvinylalcohol is obtained by hydrolysis of polyvinyl acetate to a degree of 70 to 100%, based on acetate.

6. The fiber according to claim 1, having a plurality of at least 30 islands of the water-insoluble poleolefin.

7. The fiber according to claim 1, having a plurality of at least 50 islands of the water-insoluble polyolefin.

8. The fiber according to claim 1, wherein the islands have a round shape.

9. The fiber according to claim 1, wherein the islands have a honeycomb shape.

10. The fiber according to claim 9, wherein the fineness is not greater than 0.1 denier per filament.

11. The fiber according to claim 9, wherein the fineness is not greater than 0.02 denier per filament.

* * * * *